US009764913B2

(12) United States Patent
Samoto

(10) Patent No.: US 9,764,913 B2
(45) Date of Patent: Sep. 19, 2017

(54) CONVEYING APPARATUS AND IMAGE RECORDING APPARATUS

(71) Applicant: BROTHER KOGYO KABUSHIKI KAISHA, Nagoya-shi, Aichi-ken (JP)

(72) Inventor: Kenji Samoto, Nagoya (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 15/337,438

(22) Filed: Oct. 28, 2016

(65) Prior Publication Data

US 2017/0123365 A1 May 4, 2017

(30) Foreign Application Priority Data

Oct. 30, 2015 (JP) ..... 2015-214863

(51) Int. Cl.

| | |
|---|---|
| ***B65H 3/44*** | (2006.01) |
| ***B65H 5/26*** | (2006.01) |
| ***G03G 15/00*** | (2006.01) |
| ***B65H 1/04*** | (2006.01) |
| ***B65H 1/28*** | (2006.01) |
| ***B65H 3/06*** | (2006.01) |

(52) U.S. Cl.

CPC ..... *B65H 3/44* (2013.01); *B65H 1/04* (2013.01); *B65H 1/28* (2013.01); *B65H 3/0684* (2013.01); *B65H 5/26* (2013.01); *G03G 15/6529* (2013.01); *B65H 2402/44* (2013.01); *B65H 2405/332* (2013.01); *B65H 2801/06* (2013.01)

(58) Field of Classification Search

CPC . B65H 1/04; B65H 1/266; B65H 1/28; B65H 3/0684; B65H 3/44; B65H 5/26; B65H 2402/10; B65H 2402/32; B65H 2402/44; B65H 2405/10; B65H 2405/33; B65H 2405/332

USPC ..... 271/9.11, 9.13

See application file for complete search history.

(56) References Cited

U.S. PATENT DOCUMENTS 5,191,382 A * 3/1993 Okamura ..... G03G 15/6502 271/9.11
5,975,515 A * 11/1999 Capri ..... B65H 1/04 271/145
7,529,499 B2 * 5/2009 Makino ..... G03G 15/6502 271/9.01

(Continued)

FOREIGN PATENT DOCUMENTS

JP 05000740 A * 1/1993
JP 2013-043776 A 3/2013

*Primary Examiner* — Prasad Gokhale

(74) *Attorney, Agent, or Firm* — Merchant & Gould P.C.

(57) ABSTRACT

A conveying apparatus includes: a first casing having a first bottom portion and formed with a conveyance path in which a sheet is conveyed; a first tray provided for the first casing and supported by the first bottom portion; a first feeding section arranged above the first tray in the first casing and configured to feed a sheet supported by the first tray in a feeding direction toward the conveyance path; a second casing being detachably attached to the first casing and located below the first bottom portion in a state that the second casing is attached to the first cashing; a second tray provided for the second casing; and a second feeding section arranged above the second tray in the second casing and configured to feed a sheet supported by the second tray in the feeding direction toward the conveyance path.

13 Claims, 7 Drawing Sheets

(56) References Cited

U.S. PATENT DOCUMENTS

| | | | | |
|---|---|---|---|---|
| 8,894,059 | B2 * | 11/2014 | Yoshida | B65H 5/00 271/145 |
| 2004/0052561 | A1 * | 3/2004 | Ouchi | B65H 1/04 399/393 |
| 2013/0050382 | A1 | 2/2013 | Okamoto | |
| 2014/0001696 | A1 * | 1/2014 | Yoshida | B65H 5/00 271/9.01 |

* cited by examiner

CONVEYING APPARATUS AND IMAGE RECORDING APPARATUS

CROSS REFERENCE TO RELATED APPLICATION

The present application claims priority from Japanese Patent Application No. 2015-214863 filed on Oct. 30, 2015 the disclosure of which is incorporated herein by reference in its entirety.

BACKGROUND

The present invention relates to a conveying apparatus configured to convey a sheet along a conveyance path, and an image recording apparatus provided with the conveying apparatus and configured to record an image on a sheet.

DESCRIPTION OF THE RELATED ART

There is known a conveying apparatus which conveys a sheet along a conveyance path formed inside the conveyance apparatus. As an apparatus provided with such a conveying apparatus, there is known an image recording apparatus such as a printer, a multi-function peripheral, etc. For example, an image recording apparatus disclosed in Japanese Patent Application Laid-open No. 2013-043776 is provided with a first casing as a main body of the apparatus (apparatus body), which includes a first tray supporting a sheet, and a second casing which is provided with a second tray supporting a sheet and which is detachably attachable to the first casing. The image recording apparatus disclosed in Japanese Patent Application Laid-open No. 2013-043776 is provided with two trays (first and second trays) by attaching the second casing to the first casing. With this, the image recording apparatus is allowed to accommodate a larger number or volume of sheets therein, than another image recording apparatus provided with only one tray.

SUMMARY

In the image recording apparatus disclosed in Japanese Patent Application Laid-open No. 2013-043776, a roller rotates in a state that the roller makes contact with a sheet supported by the first tray from a position above the sheet. With this, the sheet is conveyed. Accordingly, a portion, of the first casing located below or under the roller, is required to have thickness greater than that of another portion of the first casing so as to resist the pressing force of the roller. Further, in the image recording apparatus disclosed in Japanese Patent Application Laid-open No. 2013-043776, the second casing is attached below the first casing.

Due to the above-described configuration, the image recording apparatus is elongated in the height direction, and thus becomes a large-sized apparatus. Further, in a case that the image recording apparatus is elongated in the height direction, the conveyance path through which the sheet is conveyed from the second tray to the first casing becomes long, thus requiring a relatively long time until the sheet is conveyed to the first casing. Furthermore, in a case that the rotational speed of the roller is increased so as to quickly convey the sheet to the first casing, the noise generated from the roller becomes loud.

The present teaching has been made in view of the above tasks. An object of the present teaching is to provide a conveying apparatus capable of suppressing any enlargement of the apparatus size, and of executing the feeding of a sheet in a short time. Another object of the present teaching is to provide an image recording apparatus provided with the conveyance apparatus.

According to an aspect of the present teaching, there is provided a conveying apparatus including:

a first casing having a first bottom portion and formed with a conveyance path in which a sheet is conveyed;

a first tray provided for the first casing and supported by the first bottom portion;

a first feeding section arranged above the first tray in the first casing and configured to feed a sheet supported by the first tray in a feeding direction toward the conveyance path;

a second casing being detachably attachable to the first casing and located below the first bottom portion in a state that the second casing is attached to the first cashing;

a second tray provided for the second casing; and a second feeding section arranged above the second tray in the second casing and configured to feed a sheet supported by the second tray in the feeding direction toward the conveyance path, wherein the first feeding section includes a first arm extending from a location above the first tray toward the first tray and configured to pivot with an extending basal end portion thereof as a pivot center, and a first roller which is rotatably supported by an extending distal end portion of the first arm, the first feeding section being configured to pivot between a first position at which the first roller makes contact with the sheet supported by the first tray and feeds the sheet to the conveyance path, and a second position at which the first roller is located above the first position, the second feeding section includes a second arm extending from a location above the second tray toward the second tray and configured to pivot with an extending basal end portion thereof as a pivot center, and a second roller which is rotatably supported by an extending distal end portion of the second arm, the second feeding section being configured to pivot between a third position at which the second roller makes contact with the sheet supported by the second tray and feeds the sheet to the conveyance path, and a fourth position at which the second roller is located above the third position, the first casing is provided with a first projecting portion projecting downwardly from the first bottom portion, a position in the feeding direction of a lower end of the first roller, under a condition that the first feeding section is located at the first position, is between an upstream-end and a downstream-end in the feeding direction of the first projecting portion, in the state that the second casing is attached to the first casing, the first projecting portion is located inside the second casing, and in a state that the second casing is attached to the first casing and that the second feeding section is located at the fourth position, at least a portion of the second feeding section is overlapped with the first projecting portion in a side view.

According to this configuration, in the state that the second casing is attached to the first casing and that the second feeding section is located at the fourth position, at least a portion of the second feeding section is overlapped with the first projecting portion in a side view. It is possible to make the height of the conveying apparatus to be low, to an extent corresponding to this overlap. With this, any enlargement of the size of the conveying apparatus can be suppressed. As a result, it is possible to execute the feeding of the sheet from the second tray to the conveyance path in a short time.

Further, according to the configuration, the first bottom portion becomes thicker at a portion thereof at which the first projecting portion is provided, which in turn increases the strength of the first bottom portion at the portion. Furthermore, according to the configuration, the position, in the feeding direction, of the lower end of the first roller in a state that the first feeding section is located at the first position is between the upstream-end and the downstream-end in the feeding direction of the first projecting portion. With this, it is possible to lower such a possibility that the first bottom portion might be curved or warped due to the pressing force of the first roller. As a result, the sheet supported by the first tray can be fed stably.

According to the present teaching, it is possible to suppress any enlargement in the size of the apparatus, and to execute the feeding of a sheet in a short time.

DESCRIPTION OF THE EMBODIMENTS

Figure 1:
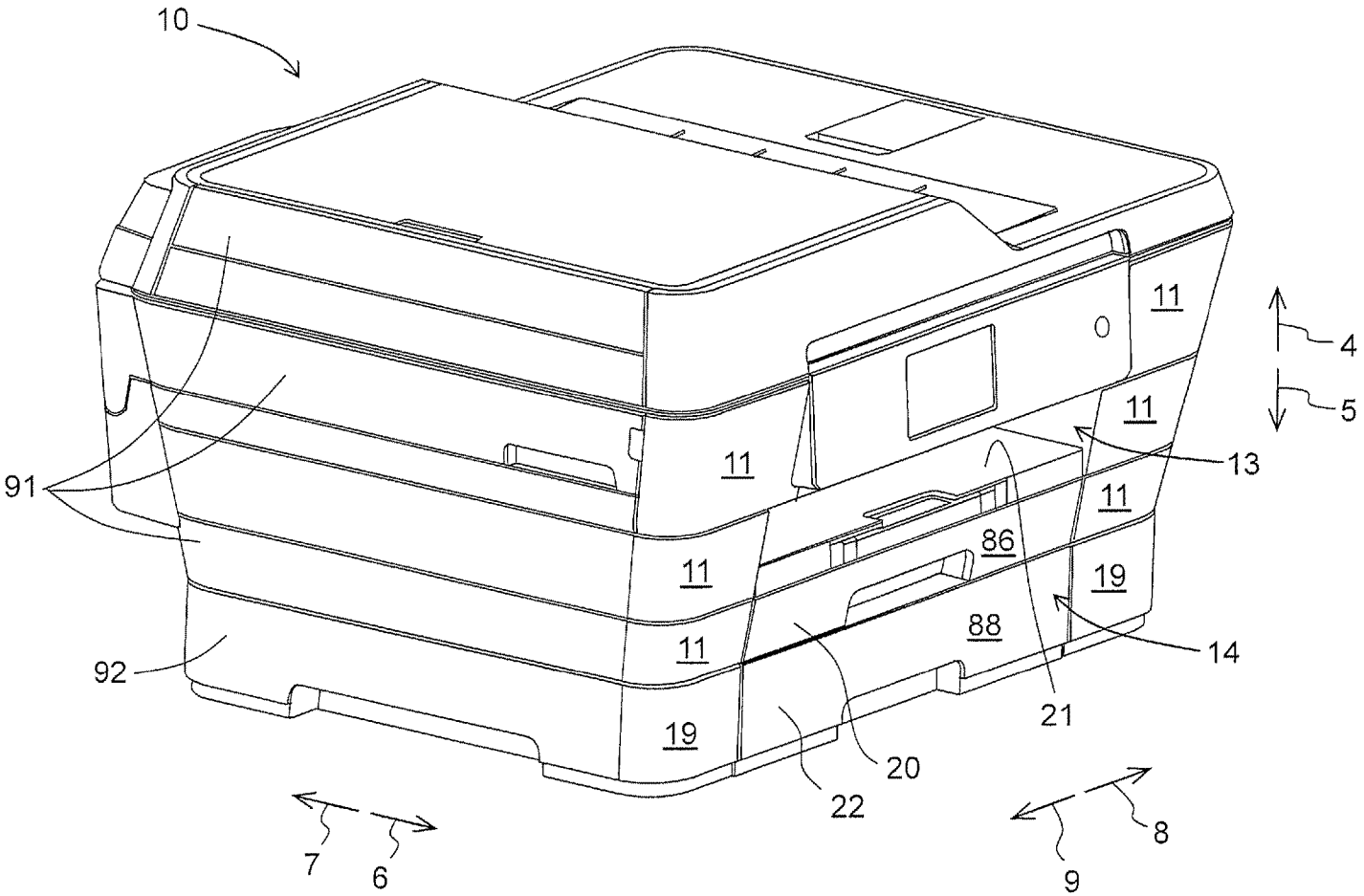
FIG. 1 is a perspective view of a multi-function peripheral.

In the following, an embodiment of the present teaching will be explained. It is needless to say that the embodiment to be explained below is merely an example of the present teaching, and that it is possible to appropriately change the embodiment of the present teaching without departing from the gist and scope of the present teaching. In the following explanation, an up direction 4 and a down direction 5 are defined with a state that a multi-function peripheral 10 is usably placed (usable state; state depicted in FIG. 1), as the reference; a front direction 6 and a rear direction 7 are defined such that a surface on which an opening 13 of the multi-function peripheral 10 is provided is the frontward surface (front surface or front side) 11; and a right direction 8 and a left direction 9 are defined as viewing the multi-function peripheral 10 from the front side thereof. The up direction 4 and the down direction 5 are opposite to each other; the front direction 6 and the rear direction 7 are opposite to each other; and the right direction 8 and the left direction 9 are opposite to each other. The up direction 4, the front direction 6 and the right direction 8 are orthogonal to one another.

<Overall Structure of Multifunction Peripheral 10>

As depicted in FIG. 1, the multi-function peripheral 10 (an example of an image recording apparatus) is formed to have a substantially rectangular parallelepiped shape. The multi-function peripheral 10 has various functions such as a facsimile function, a print function, etc. As the print function, the multi-function peripheral 10 has a function of recording an image, etc., on a paper 12 (paper sheet or sheet 12; an example of a sheet; see FIG. 2). Note that although the multi-function peripheral 10 has the function of recording an image, etc., only one surface of the sheet 12, the multi-function peripheral 10 may have a function of recording an image, etc., on both surfaces of the sheet 12.

Figure 2:
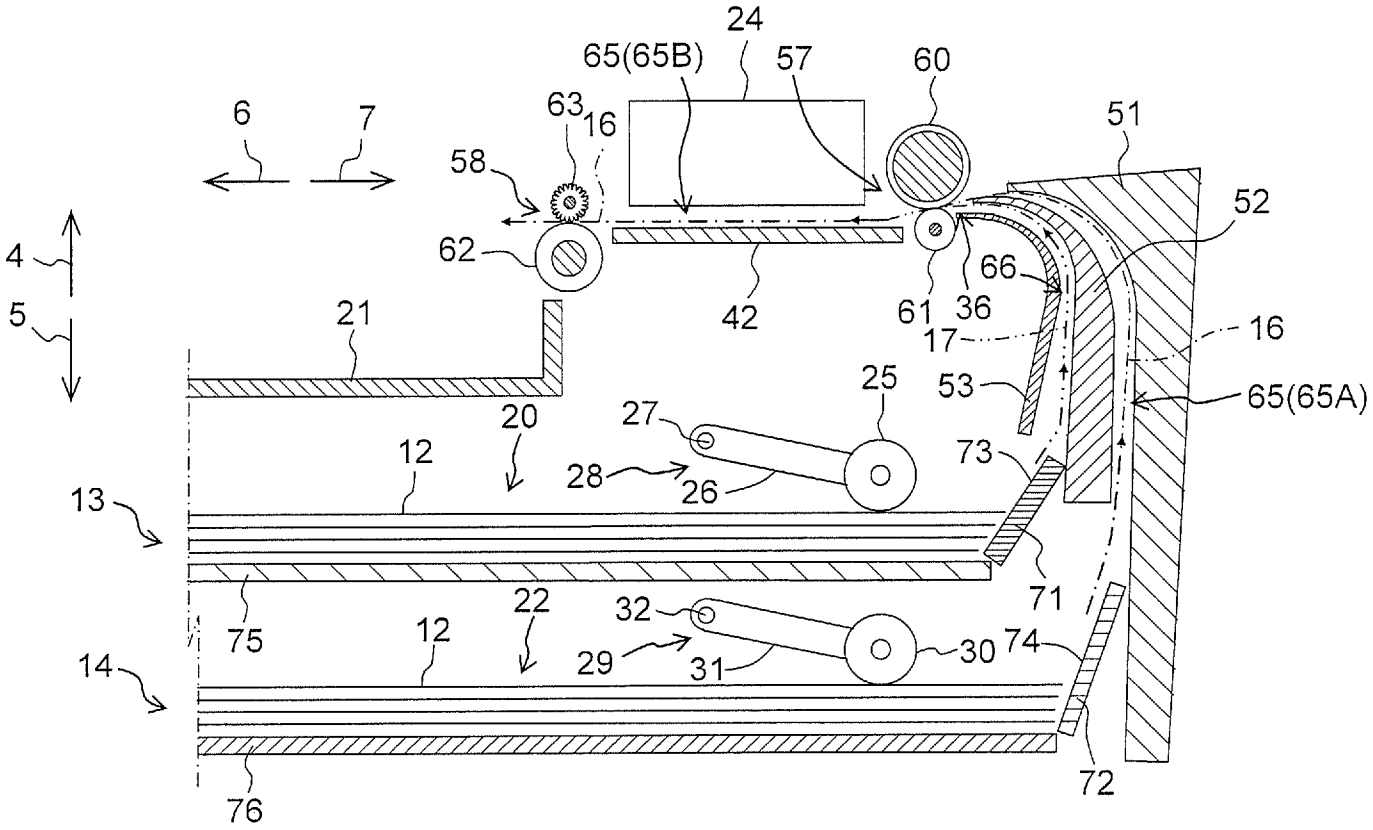
FIG. 2 is a vertical cross-sectional view schematically depicting the interior of the multi-function peripheral.

As depicted in FIG. 2, the multi-function peripheral 10 is provided with a conveying apparatus, a recording section 24 and a platen 42. The conveying apparatus is provided with a first casing 91 (see FIG. 4), a second casing 92 (see FIG. 4), frames 95 and 98 (see FIG. 4), a conveying roller pair 57, a discharging roller pair 58, a first feeding tray 20 (an example of a first tray), a second feeding tray 22 (an example of a second tray), a discharge tray 21, a first feeding section 28, a second feeding section 29, a first guide member 71 and a second guide member 72.

<First Casing 91>

As depicted in FIG. 1, the first casing 91 constructs an upper portion in the exterior of the multi-function peripheral 10, and is formed to have a substantially rectangular parallelepiped shape.

The conveying roller pair 57, the discharging roller pair 58, the first feeding section 28 and the first guide member 71 depicted in FIG. 2 are arranged in the inside of the first casing 91. A first conveyance path 65 (an example of a conveyance path) and a second conveyance path 66 (an example of the conveyance path) along each of which the sheet 12 is conveyed are formed inside the first casing 91. The opening 13 is formed in the front surface 11 of the first casing 91. The first feeding tray 20 is installed in the first casing 91 via the opening 13, and is removed from the first casing 91 via the opening 13.

Figure 4:
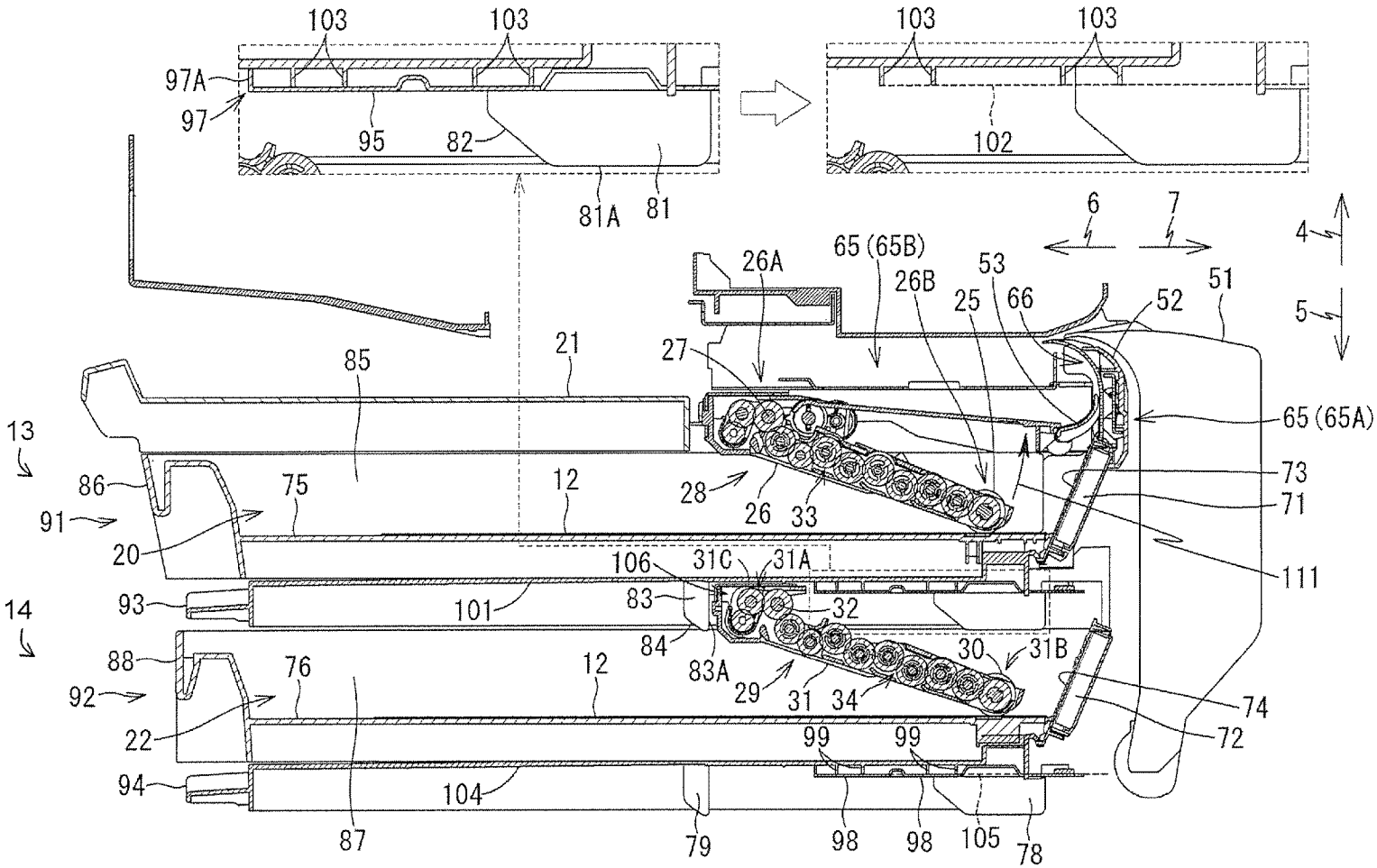
FIG. 4 is a vertical cross-sectional view of a first casing and the second casing, depicting a state that a second feeding section is located at a third position.

As depicted in FIG. 4, the first casing 91 is provided with a bottom portion 93 (an example of a first bottom portion). The bottom portion 93 is formed to have a plate shape spreading in the front and rear directions 6 and 7 and in the right and left directions 8 and 9. The bottom portion 93 supports the first feeding tray 20, which is installed in the first casing 91, from a position below the first feeding tray 20.

<Second Casing 92>

Figure 3:
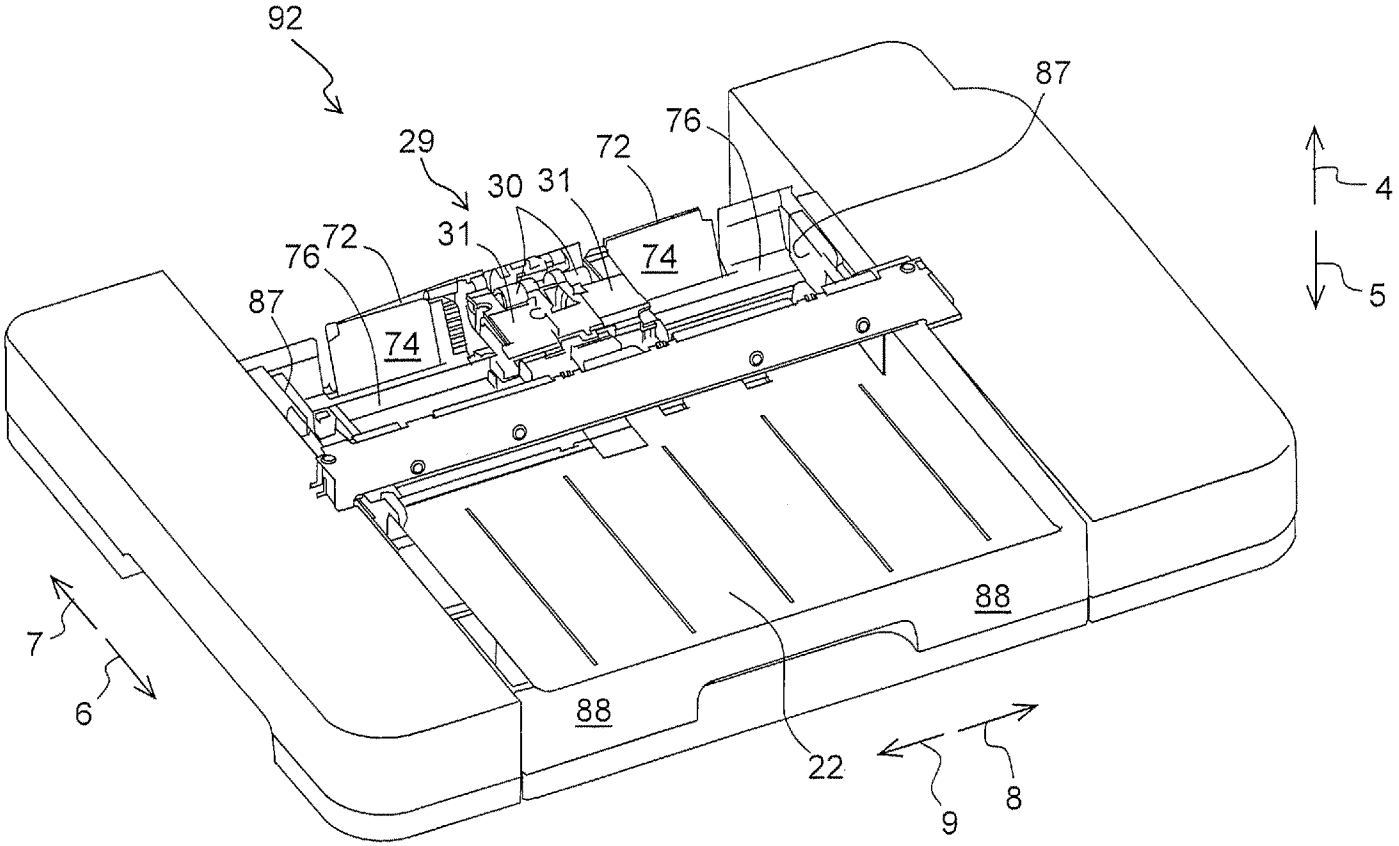
FIG. 3 is a perspective view of a second casing.

As depicted in FIGS. 1 and 3, the second casing 92 constructs a lower portion in the exterior of the multi-function peripheral 10, and is formed to have a substantially rectangular parallelepiped shape.

The second casing 92 is configured to be detachably installable with respect to the first casing 91. The attachment and detachment of the second casing 92 with respect to the first casing 91 is performed, for example, by a well-known means such as fitting, engagement, etc. As depicted in FIG. 1, the second casing 92 installed in the first casing 91 is located at a position below the first casing 91.

An opening 14 is formed in a front surface 19 of the second casing 92. The second feeding tray 22 is installed in the second casing 92 via the opening 14, and is removed from the second casing 92 via the opening 14. In a state that the second feeding tray 22 is installed in the second casing 92, an upper portion of the second casing 92 is open.

As depicted in FIG. 4, the second casing 92 is provided with a bottom portion 94 (an example of a second bottom portion). The bottom portion 94 is formed to have a plate shape spreading in the front and rear directions 6 and 7 and in the right and left directions 8 and 9. The bottom portion 94 supports the second feeding tray 22, which is installed in the second casing 92, from below the second feeding tray 22.

<First Feeding Tray 20, Second Feeding Tray 22 and Discharge Tray 21>

As depicted in FIG. 1, the first feeding tray 20 is disposed on the first casing 91. The first feeding tray 20 is installed in the first casing 91 by being inserted, via the opening 13, to the first casing 91 in the rear direction 7; and the first feeding tray 20 is removed, via the opening 13, from the first casing 91 in the front direction 6.

As depicted in FIGS. 1 and 3, the second feeding tray 22 is disposed on the second casing 92. The second feeding tray 22 is installed in the second casing 92 by being inserted, via the opening 14, to the second casing 92 in the rear direction 7; and the second feeding tray 22 is removed, via the opening 14, from the second casing 92 in the front direction 6.

As depicted in FIG. 2, in a state that the first feeding tray 20 is installed in the first casing 91, the first feeding tray 20 is arranged at a position below the recording section 24. As depicted in FIGS. 1 and 2, in the state that the second feeding tray 22 is installed in the second casing 92, the second feeding tray 22 is arranged at a position below the first feeding tray 20 installed in the first casing 91. In the state that the first feeding tray 20 is installed in the first casing 91, a sheet 12 supported by the first feeding tray 20 becomes conveyable to the second conveyance path 66. In the state that the second feeding tray 22 is installed in the second casing 92, a sheet 12 supported by the second feeding tray 22 becomes conveyable to the first conveyance path 65.

Each of the first and second feeding trays 20 and 22 is formed to have a shape of a box which is substantially rectangular parallelepiped. As depicted in FIGS. 2 and 4, the first feeding tray 20 is provided with a bottom plate 75 in which a plurality of pieces of the sheet 12 are supported in a stacked state on the bottom plate 75; a pair of side plates 85 extending upward respectively from a right end portion and a left end portion of the bottom plate 75; and a front plate 86 extending upward from a front end portion of the bottom plate 75. As depicted in FIGS. 3 and 4, the second feeding tray 22 is provided with a bottom plate 76 in which a plurality of pieces of the sheet 12 are supported in a stacked state on the bottom plate 76; a pair of side plates 87 extending upward respectively from a right end portion and a left end portion of the bottom plate 76; and a front plate 88 extending upward from a front end portion of the bottom plate 76.

In this embodiment, the maximum number of the sheet 12 stackable in each of the first and second trays 20 and 22 is 500 sheets. Note that the maximum number of the stackable sheets 12 may be other than 500 sheets. Further, the maximum number of the stackable sheets 12 may be same number for the respective feeding trays 20 and 22 or may be different numbers for the respective feeding trays 20 and 22.

As depicted in FIGS. 2 and 4, the discharge tray 21 is arranged at a position that is below the recording section 24 and is above the first feeding tray 20 installed in the first casing 91. The discharge tray 21 supports a sheet 12 discharged from the first casing 91.

As depicted in FIG. 2, the sheet 12 supported by the bottom plate 76 is fed in the rear direction 7 (an example of the feeding direction) by the second feeding section 29 to thereby being fed to the first conveyance path 65. The sheet 12 is conveyed along the first conveyance path 65 in a conveyance direction 16 which is indicated by arrows of a dashed-dotted line depicted in FIG. 2. In a case that a downstream end of the sheet 12 which is being conveyed in the first conveyance path 65 reaches the conveying roller pair 57, the sheet 12 is conveyed by the conveying roller pair 57 along the first conveyance path 65 in the conveyance direction 16 toward the recording section 24. On the sheet 12 reaching a location immediately below the recording section 24, an image is recorded by the recording section 24. The sheet 12 having the image recorded thereon is conveyed by the discharging roller pair 58 along the first conveyance path 65 in the conveyance direction 16, and is discharged to the discharge tray 21.

The sheet 12 supported by the bottom plate 75 is fed in the rear direction 7 by the first feeding section 28 to thereby being fed to the second conveyance path 66. The sheet 12 is conveyed along the second conveyance path 66 in a conveyance direction 17 which is indicated by arrows of a two-dotted chain line depicted in FIG. 2. The second conveyance path 66 is joined to the first conveyance path 65 at a joint position 36. Here, the joint position 36 is located on the upstream side in the conveyance direction 16 with respect to the conveying roller pair 57. The sheet 12 conveyed to the first conveyance path 65 via the joint position 36 is conveyed along the first conveyance path 65 toward the recording section 24, in a similar manner with the sheet 12 supported by the bottom plate 76.

<First Feeding Section 28 and Second Feeding Section 29>

As depicted in FIGS. 2 and 4, the first feeding section 28 is disposed at a position above the bottom plate 75 of the first feeding tray 20 in the state that the first feeding tray 20 is installed in the first casing 91. The first feeding section 28 includes a first feeding roller 25 (an example of a first roller), a first arm 26, a first shaft 27 and a driving transmitting mechanism 33.

The first shaft 27 is supported by a frame (not depicted in the drawings) constructing a right-side portion of the first casing 91. Note that the first shaft 27 may be supported by a frame (not depicted in the drawings) constructing a left-side portion of the first casing 91. The first arm 26 is rotatably supported by the first shaft 27, with the first shaft 27 as the rotating center. The first arm 26 is extending, at a central portion in the right and left direction of the first casing 91, from an extending basal end portion 26A supported by the first shaft 27, toward the bottom plate 75 or toward the sheet 12 supported by the bottom plate 75. Namely, the first arm 26 is rotatable with the extending basal end portion 26A as the rotating center.

The first feeding roller 25 is rotatably supported by an extending distal end portion 26B of the first arm 26. The first arm 26 is downwardly urged to rotate by the self-weight of the first arm 26 or by an elastic force brought about a spring, etc. With this, in a case that the sheet(s) 12 is/are not supported by the bottom plate 75, the first feeding roller 25 makes contact with the bottom plate 75. On the other hand, in a case that the sheets 12 are supported by the bottom plate 75, the first feeding roller 25 makes contact with an uppermost sheet 12 among the sheets 12 supported by the bottom plate 75.

The position of the first feeding roller 25 becomes different depending on the number of the sheet 12 supported by the bottom plate 75. Specifically, as the number of the sheet 12 supported by the bottom plate 75 is greater, the first feeding roller 25 is located at a further rear and upper position. Further, the angle of an extending direction of the first arm 26 relative to the front direction 6 or the rear direction 7 is different depending on the number of the sheet 12 supported by the bottom plate 75. Specifically, as the number of the sheet 12 supported by the bottom plate 75 is smaller, the angle becomes closer to 90 degrees.

The first feeding roller 25 is rotated by being imparted with a driving force from a motor (not depicted in the drawings) via the driving transmitting mechanism 33 which is constructed of a plurality of gears meshing with each other (see FIG. 4). The motor may be a motor same as, or different from, a motor imparting the driving force to a conveyance motor 60 and a discharging roller 62 as will be described later on. The first feeding roller 25 which is rotating picks up an uppermost sheet 12, among the sheets 12 supported by the bottom plate 75 in a state that the sheets 12 are stacked, and feeds the uppermost sheet 12 in the rear direction 7. Note that in a case that the number of the sheet 12 supported by the bottom plate 75 is 1 (one) sheet, the first feeding roller 25 picks up the one sheet 12 and feeds the one sheet 12 in the rear direction 7. Further, the driving transmitting mechanism 33 is not limited to the aspect constructed of the plurality of gears meshing with each other, and may be, for example, a belt suspended between the first shaft 27 and the shaft of the first feeding roller 25.

Figure 5:
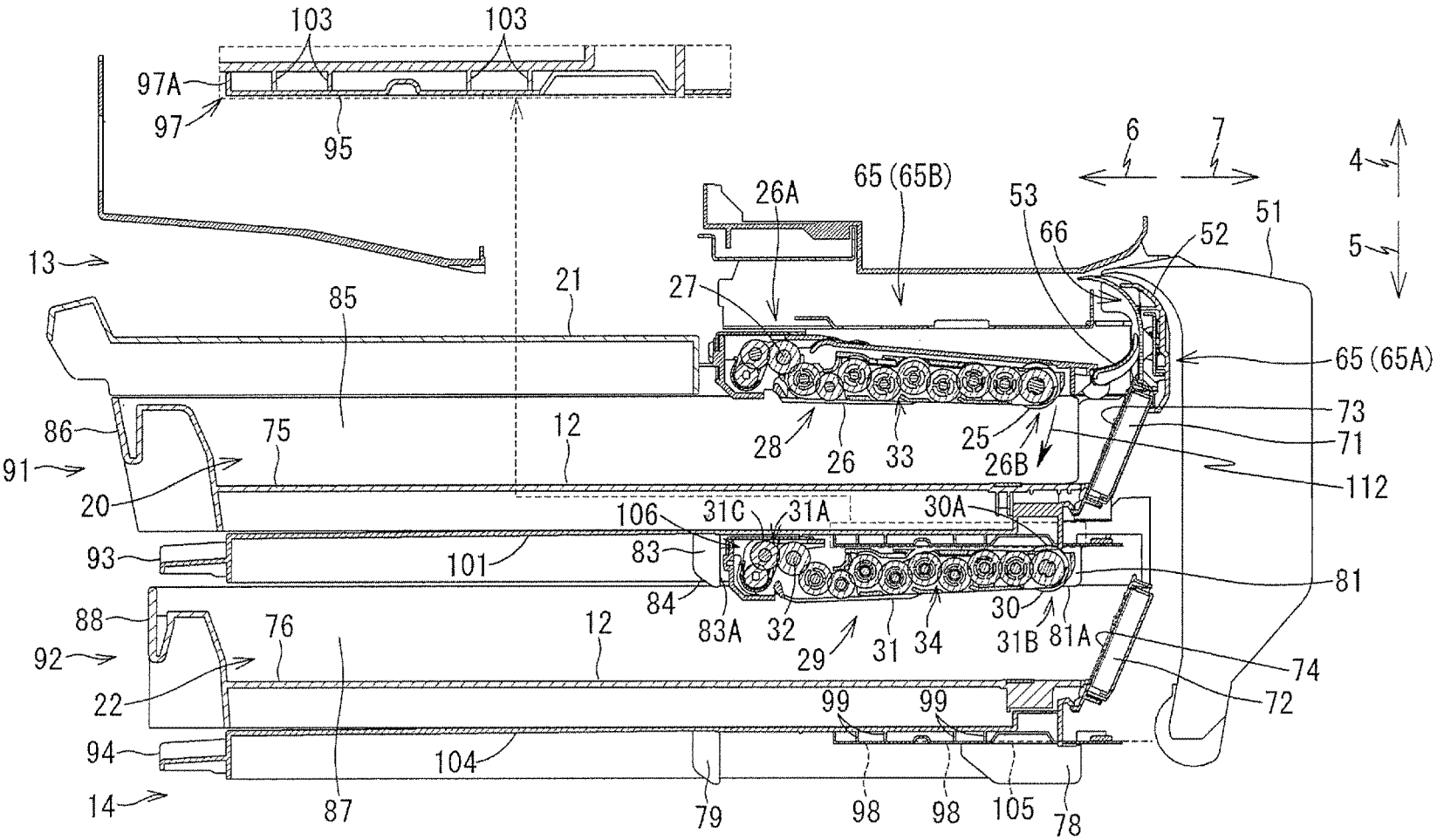
FIG. 5 is a vertical cross-sectional view of the first casing and the second casing, depicting a state that a first feeding section is located at a second position and that the second feeding section is located at a fourth position.

The first feeding section 28 is rotatable to a first position depicted in FIG. 4 and to a second position depicted in FIG. 5. Specifically, the first feeding section 28 is moved from the first position to the second position by rotating in a direction of an arrow 111 (see FIG. 4) and is moved from the second position to the first position by rotating in a direction of an arrow 112 (see FIG. 5).

The first position is a position of the first feeding section 28 at which the first feeding roller 25 is capable of making contact with the sheet 12 supported by the first feeding tray 20 and of feeding the sheet 12 in the rear direction 7.

In the embodiment, in the case that the number of the sheet 12 supported by the first feeding tray 20 is 1 (one), the first position is a position of the first feeding section 28 in a state that the first feeding roller 25 makes contact with the one sheet 12 from thereabove.

On the other hand, the second position is a position of the first feeding section 28 in a state that the first feeding roller 25 is located to be above the position of the first feeding roller 25 in a state that the first feeding section 28 is located at the first position.

In the embodiment, the second position is a position of the first feeding section 28 in a state that a lower end of the first feeding roller 25 is located further above an uppermost sheet 12 in a case that the maximum number of the sheet 12 stackable in the first feeding tray 20 (500 sheets) is supported by the first feeding tray 2.

Note that the first feeding section 28 is moved pivotally to the second position in a process during which the first feeding tray 20 is inserted and removed with respect to the first casing 91. Specifically, in the process during which the first feeding tray 20 is inserted and removed with respect to the first casing 91, a right end portion or a left end portion of the first arm 26 is contacted by the upper surface of one of the side plates 85 from therebelow and is pressed upward by the side plate 85, thereby moving the first feeding section 28 pivotally to the second position.

Note that the first position and the second position are not limited to the positions in the embodiment. For example, in a case that two or more pieces of the sheet 12 are supported by the first feeding tray 20 in the stacked state, the first position may be a position of the first feeding section 28 in a state that the first feeding roller 25 makes contact with the uppermost sheet 12 from thereabove. Further, for example, the second position may be a position of the first feeding section 28 in a state that the first feeding roller 25 is in contact with an uppermost sheet 12 from above, in a case that sheets 12, the number of which is greater than the number of the sheets 12 when the first feeding section 28 is located at the first position, are supported by the first feeding tray 28 in the stacked state.

The second feeding section 29 is disposed at a position above the bottom plate 76 of the second feeding tray 22 in the state that the second feeding tray 22 is installed in the second casing 92. The second feeding section 29 includes a second feeding roller 30 (an example of a second roller), a second arm 31, a second shaft 32 (an example of the pivot shaft) and a driving transmitting mechanism 34.

The second shaft 32 is supported by a frame (not depicted in the drawings) constructing a right-side portion of the second casing 92. Note that the second shaft 32 may be supported by a frame (not depicted in the drawings) constructing a left-side portion of the second casing 92. The second arm 31 is rotatably supported by the second shaft 32, with the second shaft 32 as the rotating center. The second arm 31 is extending, at a central portion in the right and left directions of the second casing 92, from an extending basal end portion 31A supported by the second shaft 32, toward the bottom plate 76 or toward the sheet 12 supported by the bottom plate 76. Namely, the second arm 31 is rotatable with the extending basal end portion 31A as the rotating center. The second feeding roller 30 is rotatably supported by an extending distal end portion 31B of the second arm 31.

The second feeding section 29 is rotatable to a third position depicted in FIG. 4 and to a fourth position depicted in FIG. 5. The third position is a position of the second feeding section 29 at which the second feeding roller 30 is capable of making contact with the sheet 12 supported by the second feeding tray 22 and of feeding the sheet 12 in the rear direction 7. On the other hand, the fourth position is a position of the second feeding section 29 in a state that the second feeding roller 30 is located above the position of the second feeding roller 30 when the second feeding section 29 is located at the third position.

Note that the second feeding roller 30, the second arm 31, the second shaft 32 and the driving transmitting mechanism 34 are configured similarly respectively to the first feeding roller 25, the first arm 26, the first shaft 27 and the driving transmitting mechanism 33 as described above. Therefore, any further explanation of the second feeding roller 30, the second arm 31, the second shaft 32 and the driving transmitting mechanism 34 will be omitted.

<First Guide Member 71 and Second Guide Member 72>

As depicted in FIGS. 2 and 4, the first guide member 71 is arranged in the inside of the first casing 91, and the second guide member 72 is arranged in the inside of the second casing 92.

The first guide member 71 is arranged on the rear side relative to a rear end portion of the first feeding tray 20 in the state that the first feeding tray 20 is installed in the first casing 91. The first guide member 71 is provided with an inclined surface 73 which is oriented in the front direction 6. The inclined surface 73 is inclined in an upper rear direction. A lower end portion of the inclined surface 73 is arranged closely to the rear end portion of the first feeding tray 20 in the state that the first feeding tray 20 is installed in the first casing 91. An upper end portion of the inclined surface 73 is arranged closely to a middle guide member 52 (to be described later on). A sheet 12 which is fed by the first feeding roller 20 in the rear direction 7 comes into contact with the inclined surface 73. With this, the sheet 12 is guided along the inclined surface 73 and is fed to the second conveyance path 66.

The second guide member 72 is arranged on the rear side relative to a rear end portion of the second feeding tray 22 in the state that the second feeding tray 22 is installed in the second casing 92. The second guide member 72 is provided with an inclined surface 74 which is oriented in the front direction 6. The inclined surface 74 is inclined in the upper rear direction. A lower end portion of the inclined surface 74 is arranged closely to the rear end portion of the second feeding tray 22 in the state that the second feeding tray 22 is installed in the second casing 92. An upper end portion of the inclined surface 74 is arranged closely to an outer guide member 51 (to be described later on). A sheet 12 which is fed by the second feeding roller 30 in the rear direction 7 comes into contact with the inclined surface 74. With this, the sheet 12 is guided along the inclined surface 74 and is fed to a curved path 65A of the first conveyance path 65.

<First Conveyance Path 65>

The first conveyance path 65 is a path along which the sheet 12 is conveyed. As depicted in FIG. 2, the first conveyance path 65 is extended from the upper end portion of the second guide member 72 up to the discharging roller pair 58, via the conveying roller pair 57 and the recording section 24. The first conveyance path 65 is constructed of the curved path 65A and a linear path 65B.

The curved path 65A is extending upward along the conveyance direction 16 while being curved frontward. A sheet 12 which is fed, from the state of being supported by the second feeding tray 22, in the rear direction 7 by the second feeding section 29 is guided along the inclined surface 74 of the second guide member 72, and is conveyed along the curved path 65A in the conveyance direction 16. With this, the sheet 12 is guided so as to make a U-turn from the lower side to the upper side in the up direction 4. The sheet 12 passing through the curved path 65A is pinched (sandwiched) by the conveying roller pair 57. The curved path 65A is defined by the outer guide member 51 and the middle guide member 52.

The linear path 65B is a path along which the sheet 12 is conveyed. The linear path 65B is continued to a downstream end in the conveyance direction 16 of the curved path 65A at the conveying roller pair 57, and is extended up to the discharging roller pair 58. The linear path 65B is extending substantially linear in the front direction 6. The sheet 12 which has reached the conveying roller pair 57 is conveyed by the conveying roller pair 57 along the linear path 65B in the front direction 6. The sheet 12 which has reached the discharging roller pair 58 is conveyed by the discharging roller pair 58 further in the front direction 6, and then is discharged to the discharge tray 21. The linear path 65B is defined by the conveying roller pair 57, the recording section 24 and the platen 42, and the discharging roller pair 58.

<Second Conveyance Path 66>

The second conveyance path 66 is a path along which the sheet 12 is conveyed. As depicted in FIG. 2, the second conveyance path 66 is located, in the first casing 91, on an inner side in the first casing 91 relative to the curved path 65A of the first conveyance path 65. The second conveyance path 66 is extended from the upper end portion of the first guide member 71 up to the joint position 36 at which the second conveyance path 66 joins the first conveyance path 65. The second conveyance path 66 is extending upward along the conveyance direction 17 while being curved frontward.

A sheet 12 which is fed, from the state of being supported by the first feeding tray 21, in the rear direction 7 by the first feeding section 28 is guided along the inclined surface 73 of the first guide member 71, and is conveyed along the second conveyance path 66 in the conveyance direction 17. With this, the sheet 12 is guided so as to make a U-turn from the lower side to the upper side in the up direction 4. The sheet 12 passing through the second conveyance path 66 enters into the first conveyance path 66 from the joint position 36, and is nipped by the conveying roller pair 57. The second conveyance path 66 is defined by the middle guide member 52 and the inner guide member 53.

<Conveying Roller Pair 57 and Discharging Roller Pair 58>

As depicted in FIG. 2, the conveying roller pair 57 is arranged on the downstream side in the conveyance direction 16 relative to the joint position 36 in the first conveyance path 65. The conveying roller pair 57 is provided with a conveying roller 60 and a pinch roller 61 facing each other. The conveying roller 60 is rotated by a driving force transmitted thereto from a motor (not depicted in the drawings). The pinch roller 61 is rotated following the rotation of the conveying roller 60. The conveying roller pair 57 pinches the sheet 12 and conveys the sheet 12 in the conveyance direction 16.

The discharging roller pair 58 is arranged, in the first conveyance path 65, on the downstream side in the conveyance direction 16 relative to the conveying roller pair 57. The discharging roller pair 58 is provided with a discharging roller 62 and a spur 63 facing each other. The discharging roller 62 is rotated by a driving force transmitted thereto from a motor (not depicted in the drawings). The spur 63 is rotated following the rotation of the discharging roller 62. The discharging roller pair 58 pinches the sheet 12 and conveys the sheet 12 in the conveyance direction 16.

Note that the respective rollers 60 and 62 may receive a driving force transmitted thereto from a same motor, or may receive driving forces transmitted thereto from different motors, respectively.

<Recording Section 24>

As depicted in FIG. 2, the recording section 24 is arranged between the conveying roller pair 57 and the discharging roller pair 58 in the first conveyance path 65. In the embodiment, the recording section 24 is configured to record, by an ink-jet system, an image, etc., on a sheet 12 which is being conveyed in the first conveyance path 65. Note that the system by which the recording section 24 records an image, etc., on the sheet 12 is not limited to the ink-jet system, and may be a system different from the ink-jet system such as an electro-photographic system, etc.

<Projecting Portion 81>

As depicted in FIG. 4, the bottom portion 93 of the first casing 91 is provided with a projecting portion 81 (an example of a first projecting portion). The projecting portion 81 projects downward from the bottom portion 93.

Figure 6:
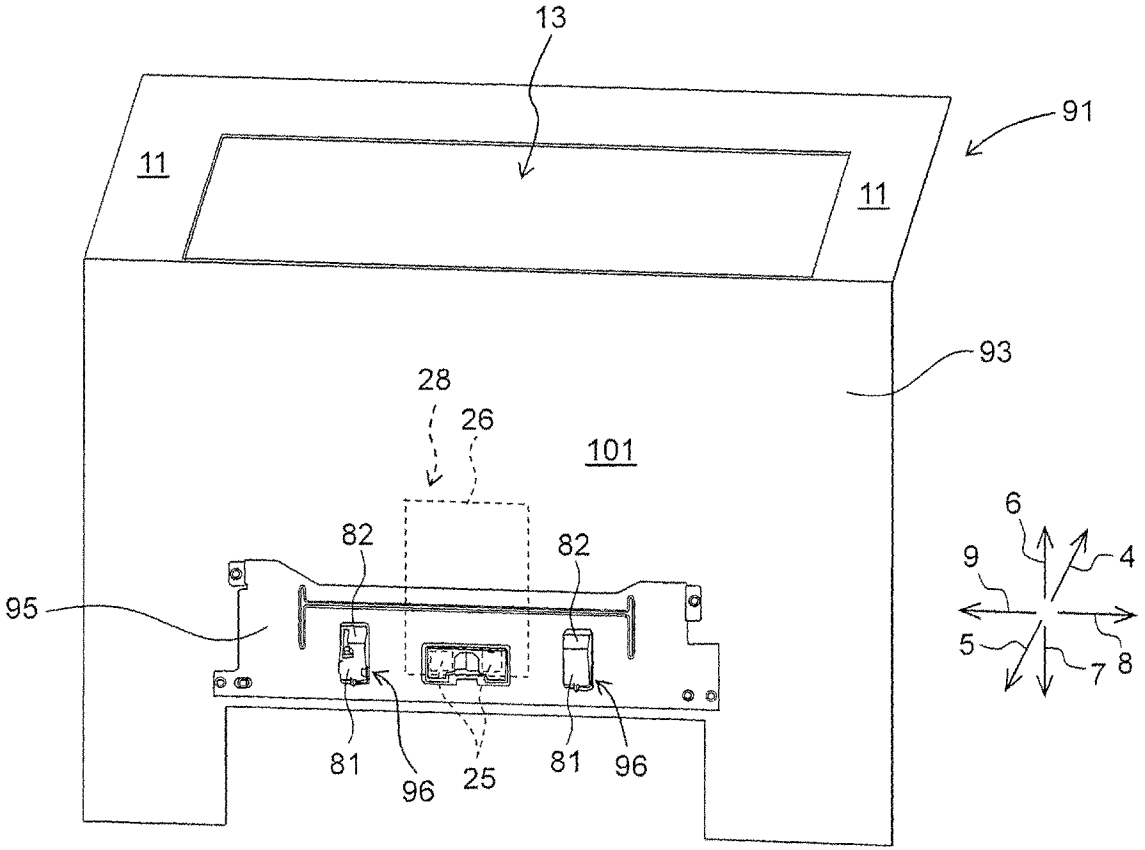
FIG. 6 is a perspective view schematically depicting the first casing as seen from therebelow.

As depicted in FIG. 6, the projecting portion 81 is provided as two projecting portions 81 arranged on the right and left sides, with a spacing distance therebetween. One of the two projecting portions 81 is arranged toward the right direction 8 (an example of a first direction) relative to the first feeding roller 25. The other of the two projecting portions 81 is arranged toward the left direction 9 (an example of a second direction) relative to the first feeding roller 25. Namely, in a case that the multi-function peripheral 10 is seen from the down direction 5 (seen from therebelow), the first feeding roller 25 is located, in the right and left directions, between the two projecting portions 81. Note that since the first feeding roller 25 is located at a position above each of the two projecting portions 81, the first feeding roller 25 is located at a position above a location between the two projecting portions 81 in a case that the multi-function peripheral 10 is seen from the front direction 6 (seen from thereabove).

As depicted in FIG. 4, the position in the rear direction 7 of the lower end of the first feeding roller 25, in a state that the first feeding section 28 is located at the first position, is between a front end and a rear end of each of the projecting portions 81. Note that the position of the first feeding roller 25 is different depending on the number of the sheet 12 supported by the bottom plate 75 as described above; in the embodiment, however, the position in the rear direction 7 of the lower end of the first feeding roller 25 is between the front end and the rear end of each of the projecting portions 81, regardless of the number of the sheet 12 supported by the bottom plate 75.

As depicted in FIG. 4, each of the projecting portions 81 is provided with an inclined surface 82 which is inclined with respect to the front direction 6. The inclined surface 82 is a surface oriented frontward and downward. The inclined surface 82 is inclined frontward and upward.

Figure 7:
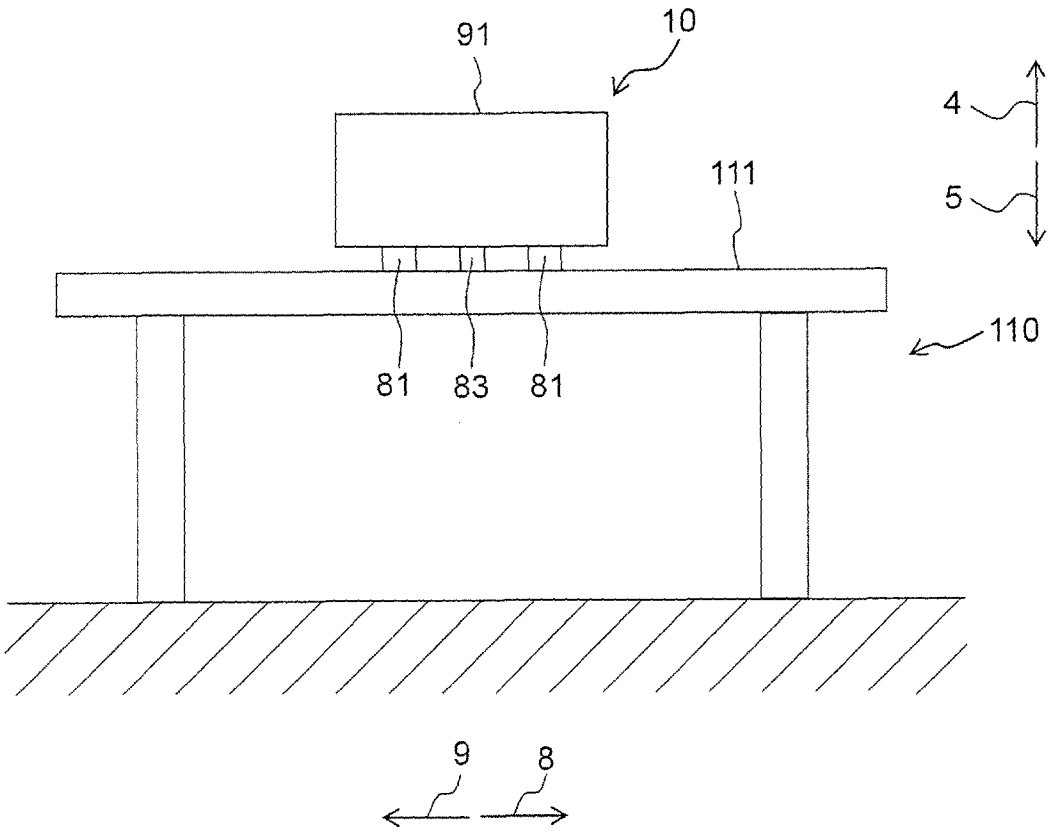
FIG. 7 is a front view depicting the multi-function peripheral to which the second casing is not attached is placed on an upper surface of a desk.

In a state that the second casing 92 is not installed in the first casing 91, the respective projecting portions 81 construct a lower end portion of the multi-function peripheral 10. With this, as depicted in FIG. 7, in a case that the multi-function peripheral 10 is placed on an upper surface 111 (an example of an apparatus-placement surface) of a desk 110 in the state wherein the second casing 92 is not installed in the first casing 91, the respective projecting portions 81 make contact with the upper surface 111 of the desk 110 from thereabove. Note that the multi-function peripheral 10 is not limited to as being placed on the upper surface 111 of the desk 110, and may be placed, for example, on an upper surface of a shelf board.

As depicted in FIG. 4, in a state that the second casing 92 is installed in the first casing 91, the respective projecting portions 81 are located in the inside of the second casing 92. Here, the phrase "the inside of the second casing 92" means a space of which upper portion is defined by the bottom portion 93 of the first casing 91 and a remaining portion of which, other than the upper portion, is defined by the second casing 92 (specifically, the bottom plate 76, the pair of side plates 87 and the front plate 88 of the second feeding tray 22) in the state that the second casing 92 is installed in the first casing 91.

In the state that the second casing 92 is installed in the first casing 91, the second shaft 32 of the second feeding section 29 is located on the front side relative to the respective projecting portions 81, and the second feeding roller 30 of the second feeding section 29 is located between the front end and the rear end of each of the projecting portions 81. Note that it is not necessarily indispensable that the entirety of the second feeding roller 30 is located between the front end and the rear end of each of the projecting portions 81; it is allowable that a portion of the second feeding roller 30 is located between the front end and the rear end of each of the projecting portions 81.

As depicted in FIG. 5, in a state that the second casing 92 is installed in the first casing 91 and that the second feeding section 29 is located at the fourth position, a lower end 81A of each of the projecting portions 81 is located at a position below an upper end 30A of the second feeding roller 30. Namely, in the state that the second feeding roller 29 is located at the fourth position, the second feeding roller 30 is overlapped with each of the projecting portions 81 as seen in the right direction 8 or the left direction 9, namely, in the side view. Further, in the state that the second feeding roller 29 is located at the fourth position, the second feeding roller 30 is in a state of being sandwiched between the two projecting portions 81 as seen in the down direction 5, namely, in the plane view.

In the state that the second casing 92 is installed in the first casing 91, the lower end 81A of each of the projecting portions 81 is located at a position above an uppermost sheet 12 in a state that the maximum number of the sheet 12 stackable in the second feeding tray 22 (500 sheets) is supported by the second feeding tray 22. Namely, in this state, each of the projecting portions 81 does not make contact with the sheets 12 supported on the second feeding tray 22.

In the state that the second casing 92 is installed in the first casing 91, an upper end 31C of the extending basal end portion 31A of the second arm 31 is located at a position above the lower end 81A of each of the projecting portions 81.

<Projecting Portion 83>

As depicted in FIG. 4, the bottom portion 93 of the first casing 91 is provided with one projecting portion 83 (an example of a second projecting portion). The projecting portion 83 projects downward from the bottom portion 93. A lower end of the projecting portion 83 is located at a same height as the lower end of each of the projecting portion 81 with respect to the up direction 4.

The projecting portion 83 is provided with an inclined surface 84 which is inclined with respect to the front direction 6. The inclined surface 84 is a surface oriented frontward and downward. The inclined surface 84 is inclined frontward and upward.

In the state that the second casing 92 is installed in the first casing 91, the projecting portion 83 is located on the front side relative to the second shaft 32. Namely, the second shaft 32 is arranged at a location between the projecting portions 81 and 83 with respect to the front and rear directions 6 and 7.

As depicted in FIG. 7, in a case that the multi-function peripheral 10 is placed on the upper surface 111 of the desk 110 in the state wherein the second casing 92 is not installed in the first casing 91, the projecting portion 83 makes contact with the upper surface 111 of the desk 110 from thereabove, in a similar manner regarding the projecting portions 81.

<First Surface 101 and Second Surface 102>

As depicted in FIG. 4, the bottom portion 93 of the first casing 91 is provided with a first surface 101 and a second surface 102.

The first surface 101 is a surface which becomes a top surface defining a space 106 in the state that the second casing 92 is installed in the first casing 91. Here, the space 106 is a space of which upper end is defined by the first surface 101, of which front end is defined by the rear surface 83A of the projecting portion 83, and of which rear end is defined by a front surface 97A of a bent portion 97 of a metallic frame 95 (which will be described later on). The second shaft 32 of the second feeding section 29 is arranged in the space 106.

A plurality of ribs 103 are formed in the first surface 101 at a location on the rear side relative to the bent portion 97 of the frame 95. Each of the ribs 103 projects downward from the first surface 101, and each of the ribs 103 is extending along the right and left directions 8 and 9. The respective ribs 103 are arranged in the front and rear directions 6 and 7 with a spacing distance therebetween. A second surface 102, which is a virtual plane spreading (extending) along the front and rear directions 6 and 7 and in the right and left directions 8 and 9 is defined by extending distal end surfaces of the respective ribs 103. The second surface 102 is located at a position below the first surface 101. The projecting portions 81 project downward each at a location on the rear side relative to the first surface 101.

Namely, the projecting portions 81 project downward from the second surface 102. Accordingly, the second surface 102 is a surface in which the projecting portions 81 are disposed.

<Frame 95>

As depicted in FIG. 4, a frame 95 made of a metal is arranged at a location below the bottom portion 93 of the first casing 91. The frame 95 is installed in the first casing 91 by a well-known means such as fitting, screw-locking (attachment with a screw), etc. The frame 95 covers the plurality of ribs 103 from therebelow. Namely, the frame 95 covers at least a portion of the second surface 102 from therebelow.

As depicted in FIG. 6, the position in the front and rear directions 6 and 7 of the lower end of the first feeding roller 25, under a condition that the first feeding section 28 is located at the first position, is between a front end and a rear end of the frame 95. Note that the position of the first feeding roller 25 is different depending on the number of the sheet 12 supported by the bottom plate 75 as described above; in the embodiment, however, the position in the front and rear directions 6 and 7 of the first feeding roller 25 is between the front end and the rear end of the frame 95, regardless of the number of the sheet 12 supported by the bottom plate 75.

As depicted in FIG. 6, the frame 95 is provided with openings 96 (an example of a penetrating portion). The openings 96 are located at positions overlapping with the projecting portions 81 respectively in a case that the frame 95 is seen from therebelow. The projecting portions 81 penetrate the openings 96 from the upper side to the lower side of the opening 96. Note that in the embodiment, the frame 95 is provided with the openings 96 as a configuration for allowing the projecting portions 81 to penetrate through the frame 95. The configuration for allowing the projecting portions 81 to penetrate through the frame 95, however, is not limited to the openings 96. For example, it is allowable that the frame 95 is provided with a cutout formed by cutting the frame 95 leftward from a right end of the frame 95, a cutout formed by cutting the frame 95 rightward from the left end of the frame 95, etc., instead of the openings 96.

As depicted in FIG. 4, the frame 95 is provided with a bent portion 97. The bent portion 97 is disposed at a front end portion of the frame 95. The frame 95 extending frontward is bent upward at the bent portion 97.

<Bottom Portion 94>

As depicted in FIG. 4, the bottom portion 94 of the second casing 92 is constructed in a similar manner to the bottom portion 93 of the first casing 91. Namely, the bottom portion 94 is provided with projecting portions 78 (an example of a third projecting portion), a projecting portion 79, ribs 99, a first surface 104, a second surface 105 and a frame 98 which correspond to the projecting portions 81, the projecting portion 83, the ribs 103, the first surface 101, the second surface 102 and the frame 95, respectively, of the bottom portion 93.

Each of the projecting portions 78 projects downward from a lower surface of the bottom portion 94. The position in the front and rear directions 6 and 7 of the lower end of the second feeding roller 30, in a state that the second feeding section 29 is located at the third position, is between a front end and a rear end of each of the projecting portions 78. In a case that the multi-function peripheral 10 is placed on the upper surface 111 the desk 110 in the state wherein the second casing 92 is installed in the first casing 91, the respective projecting portions 78 and 79 make contact with the upper surface 111 of the desk 110, etc., from thereabove.

The projecting portions 78, the projecting portion 79, the ribs 99, the first surface 104, the second surface 105 and the frame 98 are constructed and arranged at positions in a similar manner regarding the projecting portions 81, the projecting portion 83, the ribs 103, the first surface 101, the second surface 102 and the frame 95, respectively. Further, the projecting portion 78 is provided in a number same as that of the projecting portion 81, and the projecting portion 79 is provided in a number same as that of the projecting portion 78. Accordingly, any further detailed explanation regarding the projecting portions 78, the projecting portion 79, the ribs 99, the first surface 104, the second surface 105 and the frame 98, other than described in the forgoing, will be omitted.

In the embodiment, the multi-function peripheral 10 is configured such that an additional casing (not depicted in the drawings) which is constructed in a similar manner to the second casing 92 is attachable at a position below the second casing 92. In such a case, in a state that the additional casing is attached to the second casing 92, the positional relationships between an additional feeding section (not depicted in the drawings) provided on the additional casing and the projecting portions 78, the projecting portion 79, the ribs 99, the first surface 104, the second surface 105 and the frame 98 is similar to the positional relationship between the second feeding section 29 and the projecting portions 81, the projecting portion 83, the ribs 103, the first surface 101, the second surface 102 and the frame 95. Here, the additional feeding section is configured to feed a sheet 12 supported by an additional feeding tray (not depicted in the drawings) installed in the additional casing, and is constructed in a similar manner to the first and second feeding sections 28 and 29.

[Effect of Embodiment]

According to the embodiment, in the state that the second casing 92 is installed in the first casing 91 and that the second feeding section 29 is located at the fourth position, the second feeding roller 30 is overlapped with the projecting portions 81 in the side view. It is possible to make the height of the multi-function peripheral 10 to be low, only to the extent corresponding to the above-described overlap. With this, any enlargement of the size of the multi-function peripheral 10 can be suppressed. As a result, it is possible to execute the feeding of the sheet 12 from the second feeding tray 22 to the first conveyance path 65 in a short time.

Further, according to the embodiment, the bottom portion 93 becomes thicker at the portions thereof at which the projecting portions 81 are provided respectively, which in turn increases the strength in the bottom portion 93 at these portions. Furthermore, according to the embodiment, the position in the front and rear directions 6 and 7 of the lower end of the first feeding roller 25 in a state that the first feeding section 28 is located at the first position is between the front end and the rear end of each of the projecting portions 81. With this, it is possible to lower such a possibility that the bottom portion 93 might be curved or warped due to the pressing force of the first feeding roller 25. As a result, the sheet 12 supported by the first feeding tray 20 can be fed stably.

Moreover, according to the embodiment, the first feeding roller 25 is in a state of being sandwiched by the projecting portions 81 from the left and right sides, respectively. With this, it is possible to lower such a possibility that one of left and right sides the bottom portion 93 might be curved or warped due to the pressing force of the first feeding roller 25.

Further, according to the embodiment, in a case that the sheet 12 supported by the second feeding tray 22 is fed by the second feeding section 29 and that the sheet 12 makes contact with the projecting portions 81, the sheet 12 is guided by the inclined surface 82 of each of the projecting portions 81. Accordingly, it is possible to lower such a possibility that the sheet 12 might be caught or hitched by the projecting portions 81.

Furthermore, according to the embodiment, the lower end 81A of each of the projecting portions 81 is located at the position above the uppermost sheet 12 in a state that the maximum number of the sheet 12 stackable in the second feeding tray 22 (500 sheets) is supported by the second feeding tray 22. With this, it is possible to prevent the sheets 12 supported in the second feeding tray 22 from making contact with the projecting portions 81.

Moreover, according to the embodiment, in the state that the second casing 92 is installed in the first casing 91, the upper end of the extending basal end portion 31A of the second arm 31 is located at the position above the lower end 81A of each of the projecting portions 81. Namely, the second arm 31 and the first projecting portions 81 are overlapped with each other in the up direction 4 and the down direction 5. It is possible to make the height of the multi-function peripheral 10 to be low, only to the extent corresponding to the above-described overlap.

Further, according to the embodiment, the thickness of the portion, in the bottom portion 93, provided with the second surface 102 is greater than that of another portion, of the bottom portion 93, provided with the first surface 101, since the second surface 102 is located at the position below the first surface 101. With this, it is possible to increase the strength of the portion, in the bottom portion 93, provided with the second surface 102. As a result, it is possible to lower such a possibility that bottom portion 93 might be curved or warped due to the pressing force of the first feeding roller 25.

Furthermore, according to the embodiment, the metallic frame 95 is provided at a certain portion of the bottom portion 93 so that the metallic frame 95 is positioned below the certain portion of the bottom portion 93. Accordingly, it is possible to increase the strength of the certain portion, in the bottom portion 93, which is provided with the metallic frame 95. As a result, it is possible to lower such a possibility that the bottom portion 93 might be curved or warped due to the pressing force of the first feeding roller 25.

Moreover, according to the embodiment, the frame 95 is provided with the bent portion 97, and thus the strength of the bottom portion 93 can be further enhanced by the frame 95.

Further, as in the embodiment, even in a case that the multi-function peripheral 10 is configured such that a casing, which is configured similarly to the second casing 92 is detachably installable in the second casing 92, it is possible to achieve the effects similar to those as described above.

[Modifications]

In the above-described embodiment, although the projecting portion 81 and the projecting portion 78 are provided as the two projecting portions 81 and the two projecting portions 78, respectively, the number of each of the projecting portions 81 and 78 is not limited to 2 (two). Further, in the above-described embodiment, although the projecting portion 83 and the projecting portion 79 are provided as the one projecting portion 83 and the one projecting portion 79, respectively, the number of each of the projecting portions 83 and 79 is not limited to 1 (one).

In the embodiment, in the case that the multi-function peripheral 10 is seen from therebelow, the first feeding roller 25 is located, in the right and left directions 8 and 9, between the two projecting portions 81. However, the arranging position of the first feeding roller 25 is not limited as being between the two projecting portions 81. For example, it is allowable that one projecting portion 81 is arranged at a central portion in the right and left directions 8 and 9 of the bottom portion 93 and that the first feeding roller 25 is arranged on the right side or the left side of the one projecting portion 81 arranged at the central portion. Note that the arranging positions of the projecting portion 78 and the second feeding roller 30, respectively, can also be modified in a similar manner to the arrangement positions of the projecting portion 81 and the first feeding roller 25 as described above.

In the embodiment, in a case that the multi-function peripheral 10 is placed on the upper surface 111 of the desk 110, etc., the projecting portions 81 and 83 make contact with the upper surface 111 of the desk 110, etc., from thereabove. However, the projecting portions 81 and 83 are not limited to those making contact with the upper surface 111 of the desk 110, etc., from thereabove. For example, in the case that the multi-function peripheral 10 is placed on the upper surface 111 the desk 110, etc., a portion configured to make contact with the upper surface 111 the desk 110, etc., may be provided on the bottom portion 93, separately from the projecting portions 81 and 83. Further, in such a case, it is allowable that each of the projecting portions 81 and 83 is formed to have an increased thickness than that of remaining portion in the bottom portion 93 which is not pressed by the first feeding roller 25 from thereabove, for the purpose of reinforcing the portion, among the bottom portion 93, which is pressed by the first feeding roller 25 from thereabove. The above-described modification regarding the projecting portions 81 and 83 is also applicable in a similar manner to the projecting portions 78 and 79.

In the embodiment, although the projecting portions 81 and 83 are provided with the inclined surfaces 82 and 84, respectively, it is allowable that the projecting portions 81 and 83 are not provided with the inclined surfaces 82 and 84, respectively. The above-described modification regarding the projecting portions 81 and 83 is also applicable in a similar manner to the projecting portions 78 and 79.

In the embodiment, although each of the first arm 26 and the second arm 31 is extending, at the central portion in the right and left directions of the first casing 91 and of the second casing 92, from the extending basal end portions 26A and 31A thereof, respectively, it is allowable that each of the first and second arms 26 and 31 is extending from another portion different from the central portion in the right and left directions of the first casing 91 or the second casing 92.

In the embodiment, although the frame 95 is attached to the first casing 95 and the frame 98 is attached to the second casing 92, it is allowable that the multi-function peripheral 10 is not provided with the frames 95 and 98. In such a case, as described above, it is preferred that each of the projecting portions 81 and 83 and each of the projecting portions 78 and 79 is formed to have an increased thickness than that of remaining portion in the bottom portion 93 or 94 which is not pressed by the first feeding roller 25 or the second feeding roller 30 from thereabove, for the purpose of reinforcing the portion, among the bottom portion 93 or 94, which is pressed by the first feeding roller 25 or the second feeding roller 30 from thereabove.

In the embodiment, although the frame 95 is bent, it is allowable that the frame 95 is not bent. Namely, it is allowable that the frame 95 is not provided with the bent portion 97. Note that the above-described modification regarding the frame 95 is also applicable in a similar manner to the frame 98.

In the embodiment, in the state that the second casing 92 is installed in the first casing 91 and that the second feeding section 29 is located at the fourth position, the lower end 81A of each of the projecting portions 81 is located at the position below the upper end 30A of the second feeding roller 30 and located at the portion above the lower end of the second feeding roller 30. Namely, in the state that the second feeding section 29 is located at the fourth position, a portion of the second feeding roller 30 is overlapped with each of the projecting portions 81 in the side view. It is allowable, however, that the entirety of the second feeding roller 30 is overlapped with each of the projecting portions 81 in the side view. Specifically, in the state that the second casing 92 is installed in the first casing 91 and that the second feeding section 29 is located at the fourth position, the lower end 81A of each of the projecting portions 81 may be located at a position below the lower end of the second feeding roller 30.

In the embodiment, in a state that the second feeding section 29 is located at the fourth position, the second feeding roller 30 included in the second feeding section 29 is overlapped with each of the projecting portions 81 of the first casing 91 in a side view. It is also allowable, however, that in a state that the second feeding section 29 is located at the fourth position, a portion which is included in the second feeding section 29 and which is different from the second feeding roller 30 is overlapped with each of the projecting portions 81 in the side view.

As depicted in FIGS. 4 and 5, in the embodiment for example, the positions of the projecting portions 81 in the front and rear directions 6 and 7 are same as the positions of the projecting portions 78 in the front and rear directions 6 and 7. Further, in the embodiment, as depicted in FIGS. 4 and 5, the second feeding roller 30 in the state of being located at the fourth position is located on the rear side as compared with (relative to) the second feeding roller 30 in the state of being located at the third position. Accordingly, even if the positions of the projecting portions 81 in the front and rear directions 6 and 7 were same as the positions of the projecting portions 78 in the front and rear directions 6 and 7, there is such a possibility that the second feeding roller 30 might be located on the rear side relative to the projecting portions 81 under the condition that the second feeding section 29 is located at the fourth position, while the second feeding roller 30 is located between the front end and the rear end of each of the projecting portions 81 under the condition that the second feeding section 29 is located at the third position. Namely, there is such a possibility that the second feeding roller 30 is not overlapped with each of the projecting portions 81 in the side view, under the condition that the second feeding section 29 is located at the fourth position. Note that in such a case, a portion of the second arm 31 is overlapped with each of the projecting portions 81 in the side view.

Note that the portion overlapping with the respective projecting portions 81 in the side view under the condition that the second feeding section 29 is located at the fourth position is not limited to the above-described portion (a portion or the entirety of the second feeding roller 30, or a portion of the second arm 31). Namely, it is allowable that the entirety of the second arm 30 is overlapped with the respective projecting portions 81 in the side view. Alternatively, it is also allowable that a portion of the second feeding roller 30 and a portion of the second arm 31 are overlapped with the respective projecting portions 81 in the side view. Further alternatively, it is also allowable that the entirety of the second feeding roller 30 and a portion of the second arm 31 are overlapped with the respective projecting portions 81 in the side view. Still alternatively, it is also allowable that a portion of the second feeding roller 30 and the entirety of the second arm 31 are overlapped with the respective projecting portions 81 in the side view. Alternatively, it is also allowable that the entirety of the second feeding roller 30 and the entirety of the second arm 31 are (namely, the entirety of the second feeding section 29 is) overlapped with the respective projecting portions 81 in the side view.

As described above, in the state that the second casing 92 is installed in the first casing 91 and that the second feeding section 29 is located at the fourth position, it is allowable that at least a portion of the second feeding section 29 is overlapped with the respective projecting portions 81 in the side view. It is possible to make the height of the multi-function peripheral 10 to be low, only to the extent corresponding to the at least partial overlap as described above. With this, any enlargement of the size of the multi-function peripheral 10 can be suppressed. As a result, it is possible to execute the feeding of the sheet 12 from the second feeding tray 22 to the first conveyance path 65 in a short time.

In the embodiment, the multi-function peripheral 10 is configured such that an additional casing (not depicted in the drawings) which is constructed in a similar manner to the second casing 92 is installable at a position below the second casing 92. It is allowable, however, that the multi-function peripheral 10 is configured such that the additional casing is not installable at a position below the second casing 92. In such a case, it is not necessarily indispensable that the bottom portion 94 of the second casing 92 is provided with the projecting portions 78 and 79. Further, in such a case, it is not necessarily indispensable that the bottom portion 94 is provided with two kinds of surfaces which are a difference in level or height (the first surface 104 and the second surface 105), and it is sufficient that the bottom portion 94 is provided with one kind of surface. Further, it is allowable that the one kind of surface makes contact with the upper surface 111 of the desk 110, etc., to thereby place the multi-function peripheral 10 on the upper surface 111 the desk 110, etc.

In the embodiment, the first feeding tray 20 is configured to be insertable and removable with respect to the first casing 91, and the second feeding tray 22 is configured to be insertable and removable with respect to the second casing 92. It is allowable, however, that the first and second feeding trays 20 and 22 are not configured to be insertable and removable with respect to the first and second casings 91 and 92, respectively. For example, it is allowable that the first and second feeding trays 20 and 22 are not inserted and removed with respect to the first and second casings 91 and 92, respectively, and that only a front portion of each of the first and second feeding trays 20 and 22 can be drawn from one of the first and second casings 91 and 92 to the outside thereof.

In the embodiment, the conveyance apparatus is an apparatus configured to convey a sheet 12 on which an image, etc. is recorded by the print function of the multi-function peripheral 10 as an example of the image recording apparatus. The conveyance apparatus, however, is not limited to such an apparatus as described above. For example, the conveyance apparatus may be provided on a scanner. In such a case, the conveyance apparatus is an apparatus configured to convey an original to be subjected to a reading operation wherein an image, etc. on the original is read by the scanner.

What is claimed is:

1. A conveying apparatus comprising:

a first casing having a first bottom portion and formed with a conveyance path in which a sheet is conveyed;

a first tray provided for the first casing and supported by the first bottom portion;

a first feeding section arranged above the first tray in the first casing and configured to feed a sheet supported by the first tray in a feeding direction toward the conveyance path;

a second casing being detachably attachable to the first casing and located below the first bottom portion in a state that the second casing is attached to the first casing;

a second tray provided for the second casing; and a second feeding section arranged above the second tray in the second casing and configured to feed a sheet supported by the second tray in the feeding direction toward the conveyance path, wherein the first feeding section includes a first arm extending from a location above the first tray toward the first tray and configured to pivot with an extending basal end portion thereof as a pivot center, and a first roller which is rotatably supported by an extending distal end portion of the first arm, the first feeding section being configured to pivot between a first position at which the first roller makes contact with the sheet supported by the first tray and feeds the sheet to the conveyance path, and a second position at which the first roller is located above the first position, the second feeding section includes a second arm extending from a location above the second tray toward the second tray and configured to pivot with a second extending basal end portion thereof as a pivot center, and a second roller which is rotatably supported by a second extending distal end portion of the second arm, the second feeding section being configured to pivot between a third position at which the second roller makes contact with the sheet supported by the second tray and feeds the sheet to the conveyance path, and a fourth position at which the second roller is located above the third position, the first casing is provided with a first projecting portion projecting downwardly from the first bottom portion, a position in the feeding direction of a lower end of the first roller, under a condition that the first feeding section is located at the first position, is between an upstream-end and a downstream-end in the feeding direction of the first projecting portion, in the state that the second casing is attached to the first casing, the first projecting portion is located inside the second casing, and in a state that the second casing is attached to the first casing and that the second feeding section is located at the fourth position, at least a portion of the second feeding section is overlapped with the first projecting portion in a side view.

2. The conveying apparatus according to claim 1, wherein in the state that the second casing is attached to the first casing and that the second feeding section is located at the fourth position, the second roller is overlapped with the first projecting portion in a side view.

3. The conveying apparatus according to claim 1, wherein the first projecting portion is provided as first projecting portions arranged respectively at positions on both sides of the first roller in a direction orthogonal to the feeding direction.

4. The conveying apparatus according to claim 1, wherein the first projecting portion includes an inclined surface inclined downward from upstream side to downstream side in the feeding direction.

5. The conveying apparatus according to claim 1, wherein the sheet is provided as a plurality of sheets, and the second tray is configured to support the plurality of sheets in a stacked state, and in a state that the second casing is attached to the first casing and that a maximum number of the sheets stackable in the second tray is supported by the second tray, a lower end of the first projecting portion is located above an uppermost sheet among the maximum number of the sheets.

6. The conveying apparatus according to claim 1, wherein in the state that the second casing is attached to the first casing, an upper end of the second extending basal end portion of the second arm is located above a lower end of the first projecting portion.

7. The conveying apparatus according to claim 1, wherein the first casing is further provided with a second projecting portion projecting downward from the first bottom portion, and in the state that the second casing is attached to the first casing, a pivot shaft of the second arm is located on an upstream side of the first projecting portion in the feeding direction, and the second projecting portion is located on the upstream side of the pivot shaft of the second arm in the feeding direction.

8. The conveying apparatus according to claim 1, wherein in a case that that the conveying apparatus is placed on a placement surface in a state that the second casing is not attached to the first casing, the first projecting portion makes contact with the placement surface.

9. The conveying apparatus according to claim 8, wherein the first bottom portion includes a first surface and a second surface, the first surface becoming a top surface defining a space in which a pivot shaft of the second arm is located in the state that the second casing is attached to the first casing, and the second surface being provided with the first projecting portion, and the second surface is located below the first surface.

10. The conveying apparatus according to claim 1, further comprising a frame made of metal and arranged below the first bottom portion, wherein in a state where the first feeding section is located at the first position, a lower end of the first roller is positioned between an upstream end and a downstream end of the frame in the feeding direction, and the frame is formed with a penetrating portion through which the first projecting portion penetrates.

11. The conveying apparatus according to claim 10, wherein the frame includes a bent portion which is bent upward.

12. The conveying apparatus according to claim 1, wherein the second casing comprises:

a second bottom portion configured to support the second tray; and a third projecting portion projecting downward from the second bottom portion, wherein in a state where the second feeding section is located at the third position, a lower end of the second roller is positioned between an upstream end and a downstream end of the third projecting portion in the feeding direction.

13. An image recording apparatus comprising:

the conveying apparatus as defined in claim 1; and a recording section configured to record an image on the sheet conveyed in the conveyance path.

* * * * *